US011359803B2

(12) United States Patent
Yu

(10) Patent No.: US 11,359,803 B2
(45) Date of Patent: Jun. 14, 2022

(54) WATER-RESISTANT LED LIGHT STRING

(71) Applicant: Ledup Manufacturing Group Limited, Irwindale, CA (US)

(72) Inventor: Jing Jing Yu, Irwindale, CA (US)

(73) Assignee: Ledup Manufacturing Group Limited, Irwindale, CA (US)

( * ) Notice: Subject to any disclaimer, the term of this patent is extended or adjusted under 35 U.S.C. 154(b) by 32 days.

(21) Appl. No.: 16/994,204

(22) Filed: Aug. 14, 2020

(65) Prior Publication Data

US 2021/0140623 A1 May 13, 2021

(51) Int. Cl.

| | |
|---|---|
| ***F21V 31/00*** | (2006.01) |
| ***F21V 19/00*** | (2006.01) |
| ***F21S 4/10*** | (2016.01) |
| *F21Y 115/10* | (2016.01) |

(52) U.S. Cl.

CPC ..... *F21V 31/005* (2013.01); *F21S 4/10* (2016.01); *F21V 19/004* (2013.01); *F21V 19/005* (2013.01); *F21V 19/0025* (2013.01); *F21Y 2115/10* (2016.08)

(58) Field of Classification Search

CPC ..... F21V 19/0025; H01R 4/72–726; H01R 33/09; F21S 4/10

See application file for complete search history.

(56) References Cited

U.S. PATENT DOCUMENTS

| | | | | |
|---|---|---|---|---|
| 4,292,099 | A * | 9/1981 | Dinger | H01R 4/22 156/196 |
| 7,931,390 | B2 | 4/2011 | Allen et al. | |
| 7,934,852 | B2 | 5/2011 | Allen et al. | |
| 9,777,892 | B1 * | 10/2017 | Rowell | F21S 4/28 |
| 2002/0075683 | A1 * | 6/2002 | Striebel | F21V 31/005 362/267 |
| 2005/0168156 | A1 * | 8/2005 | Li | H05B 45/00 315/185 R |
| 2006/0139920 | A1 * | 6/2006 | Allen | F21V 31/04 362/249.01 |
| 2007/0102722 | A1 * | 5/2007 | Ishizaka | H01L 33/641 257/99 |
| 2010/0296290 | A1 * | 11/2010 | Yang | F21S 4/10 362/249.16 |
| 2011/0194284 | A1 * | 8/2011 | Quaal | F21S 4/10 362/249.02 |

(Continued)

FOREIGN PATENT DOCUMENTS

| | | | | |
|---|---|---|---|---|
| CN | 106499986 A * | 3/2017 | | F21S 4/10 |
| CN | 210687847 U | 6/2020 | | |

OTHER PUBLICATIONS

Machine translation of CN 106499986 A, retrieved from worldwide.espacenet.com on Nov. 10, 2021 (Year: 2021).*

*Primary Examiner* — Rajarshi Chakraborty
*Assistant Examiner* — Steven Y Horikoshi
(74) *Attorney, Agent, or Firm* — William W. Cochran; Cochran Freund & Young, LLC

(57) ABSTRACT

Disclosed are various embodiments of LED lamps that are both watertight and waterproof for use in outdoor venues. The LED lamps can easily be assembled using automated or manual techniques and provide a reliable source of outdoor lighting for many years. Simple and inexpensive techniques are used to assemble the LED lamps that allow the lamps to be produced at a reasonable price.

17 Claims, 28 Drawing Sheets

(56) References Cited

U.S. PATENT DOCUMENTS

| | | | | |
|---|---|---|---|---|
| 2013/0003390 | A1* | 1/2013 | Wu | F21V 19/001<br>362/311.02 |
| 2015/0211727 | A1* | 7/2015 | Loomis | F21S 4/10<br>362/311.02 |

* cited by examiner

WATER-RESISTANT LED LIGHT STRING

BACKGROUND

Outdoor decorative lighting is being used on a more frequent basis for both commercial applications and personal applications. Light emitting diodes (LEDs) are increasingly being used for various forms of decorative lighting. LEDs can now present a bright source of illumination which is useful outdoors. In addition, LEDs provide a reliable, long-lasting source of light and are inexpensive to operate.

SUMMARY OF THE INVENTION

The present invention may therefore comprise a water resistant light emitting diode (LED) core comprising: an LED element comprising: a diode portion of said LED element; a positive LED lead connected to said diode portion; a negative LED lead connected to said diode portion; an LED lens that covers said diode portion and connections of said positive LED and said negative LED lead to said diode portion so that said positive LED lead and said negative LED lead protrude from said LED lens; a first wire connected to said positive LED lead to create a first electrical connection; a fusible insulator disposed between said positive LED lead and said negative LED lead that is partially melted to encapsulate and insulate said positive LED lead, said first wire and said first electrical connection, and said negative LED lead, said second wire and said second electrical connection to form a melted fusible insulator; at least one heat shrink tube that overlaps a portion of said LED lens and said melted fusible insulator that is shrunk to provide a watertight seal between said LED lens and said melted fusible insulator to produce said water resistant light core. The light emitting diode parallel array of claim 1 further comprising: a plurality of additional light emitting diode parallel arrays that are connected in series with said light emitting diode parallel array to form a light string.

The present invention may further comprise a light emitting diode (LED) lamp comprising a water resistant light core comprising an LED element comprising: a diode portion of the LED element; a first lead connected to the diode portion; a second lead connected to the diode portion; an LED lens that covers the diode portion and connections of the first lead and the second lead to the diode portion; a first wire connected to the first lead to create a first electrical connection; a second wire connected to the second lead to create a second electrical connection; a fusible insulator disposed between the first lead and the second lead, the first wire and the second wire and the first electrical connection and the second electrical connection that is partially melted to encapsulate and insulate the first lead and the second lead, the first wire and the second wire and the first electrical connection and the second electrical connection to form a melted fusible insulator; at least one heat shrink tube that overlaps a portion of the LED lens and the melted fusible insulator that is shrunk to provide a watertight seal between the LED lens and the melted fusible insulator to produce a water resistant light core; a lamp holder placed over the water resistant LED light core having a jacket with openings formed in the jacket and a transmissive cover around the LED element to produce the LED lamp.

The present invention may further comprise a method of making a water resistant light emitting diode (LED) light core comprising: providing an LED element having a diode portion, a first LED lead connected to the diode portion, a second LED lead connected to the diode portion and an LED lens that covers the diode portion; connecting a first wire to the first LED lead; connecting a second wire to the second LED lead; placing a fusible insulator between the first LED lead and the second LED lead, and between the first wire and the second wire; at least partially melting the fusible insulator so that the fusible insulator encapsulates and insulates the first LED lead and the second LED lead and the first wire and the second wire to form a melted fusible insulator; at least one heat shrink tube placed around the melted fusible insulator and overlapping a portion of the LED lens; applying heat to the heat shrink tube to shrink the heat shrink tube and seal the LED lens and the melted fusible insulator to form the water resistant LED light core.

The present invention may further comprise a method of making a light emitting diode (LED) lamp comprising: providing an LED element having a diode portion, a first LED lead connected to the diode portion, a second LED lead connected to the diode portion and an LED lens that covers the diode portion; connecting a first wire to the first LED lead; connecting a second wire to the second LED lead; placing a fusible insulator between the first LED lead and the second LED lead, and between the first wire and the second wire; at least partially melting the fusible insulator so that the fusible insulator encapsulates and insulates the first LED lead and the second LED lead and the first wire and the second wire to form a melted fusible insulator; at least one heat shrink tube placed around the melted fusible insulator and overlapping a portion of the LED lens; applying heat to the heat shrink tube to shrink the heat shrink tube and seal the LED lens and the melted fusible insulator to form the water resistant LED light core; placing a lamp holder over the water resistant LED light core to produce the LED lamp.

The present invention may further comprise a series resistor LED light core comprising a water resistant light core comprising: an LED comprising: a diode portion of the LED element; a first lead connected to the diode portion; a second lead connected to the diode portion; an LED lens that covers the diode portion and connections of the first lead and the second lead to the diode portion; a resistor having a first end connected to the first lead to form a first electrical connection; a first wire connected to a second end of the resistor to form a second electrical connection; a second wire connected to the second lead to create a third electrical connection; a fusible insulator disposed between the first lead, the resistor and the second lead, the first wire and the second wire and the first electrical connection, the second electrical connection and the third electrical connection, the fusible insulator being partially melted to encapsulate and insulate the first lead, the resistor, and the second lead, the first wire and the second wire and the first electrical connection, the second electrical connection and the third electrical connection to form a melted fusible insulator, at least one heat shrink tube that overlaps a portion of the LED lens and the melted fusible insulator that is shrunk to provide a watertight seal between the LED lens and the melted fusible insulator to produce a water resistant light core.

The present invention may further comprise a method of making a series resistor, water resistant light emitting diode (LED) light core comprising: providing an LED element having a diode portion, a first LED lead connected to the diode portion, a second LED lead connected to the diode portion and an LED lens that covers the diode portion; connecting the first LED lead to a first end of a resistor; connecting a first wire to a second end of the resistor; connecting a second wire to the second LED lead; placing a fusible insulator between the first LED lead and the second LED lead, and between the first wire, the first end of the resistor, the second end of the resistor and the second wire; at least partially melting the fusible insulator so that the fusible insulator encapsulates and insulates the first LED lead and the second LED lead and the first wire, the first end of the resistor, the second end of the resistor and the second wire to form a melted fusible insulator; at least one heat shrink tube placed around the melted fusible insulator and overlapping a portion of the LED lens; applying heat to the heat shrink tube to shrink the heat shrink tube and seal the LED lens and the melted fusible insulator to form the water resistant LED light core.

The present invention may further comprise a method of making a light emitting diode (LED) lamp comprising: providing an LED element having a diode portion, a first LED lead connected to the diode portion, a second LED lead connected to the diode portion and an LED lens that covers the diode portion; connecting the first LED lead to a first end of a resistor; connecting a first wire to a second end of the resistor; connecting a second wire to the second LED lead; placing a fusible insulator between the first LED lead and the second LED lead, and between the first wire, the first end of the resistor, the second end of the resistor and the second wire; at least partially melting the fusible insulator so that the fusible insulator encapsulates and insulates the first LED lead and the second LED lead and the first wire, the first end of the resistor, the second end of the resistor and the second wire to form a melted fusible insulator; at least one heat shrink tube placed around the melted fusible insulator and overlapping a portion of the LED lens; applying heat to the heat shrink tube to shrink the heat shrink tube and seal the LED lens and the melted fusible insulator to form the water resistant LED light core; placing a lamp holder over said water resistant LED light core to produce said LED lamp.

DETAILED DESCRIPTION OF THE EMBODIMENTS

Figure 1A:
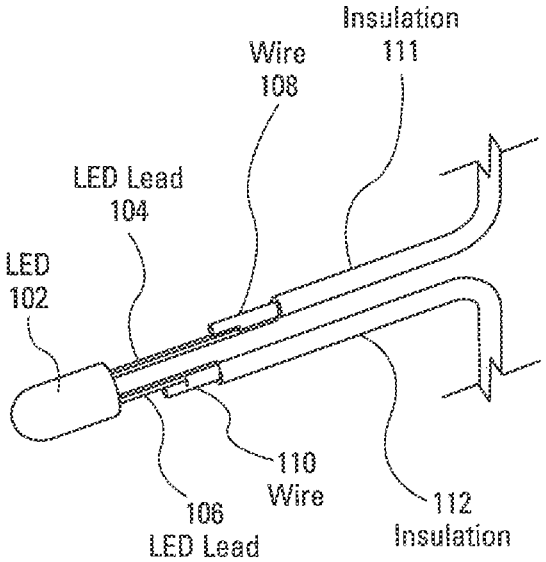
FIG. 1A is an isometric view of an embodiment of an LED and a pair of connecting wires.

FIG. 1A is an isometric view of an embodiment of an LED 102 that is connected to a pair of wires 108, 110. As illustrated in FIG. 1A, LED 102 has LED leads 104, 106. LED lead 104 is soldered or crimp connected to wire 108. Similarly, LED lead 106 is soldered or crimp connected to wire 110. Wire 108 is covered with insulation 111 while wire 110 is covered with insulation 112.

Figure 1B:
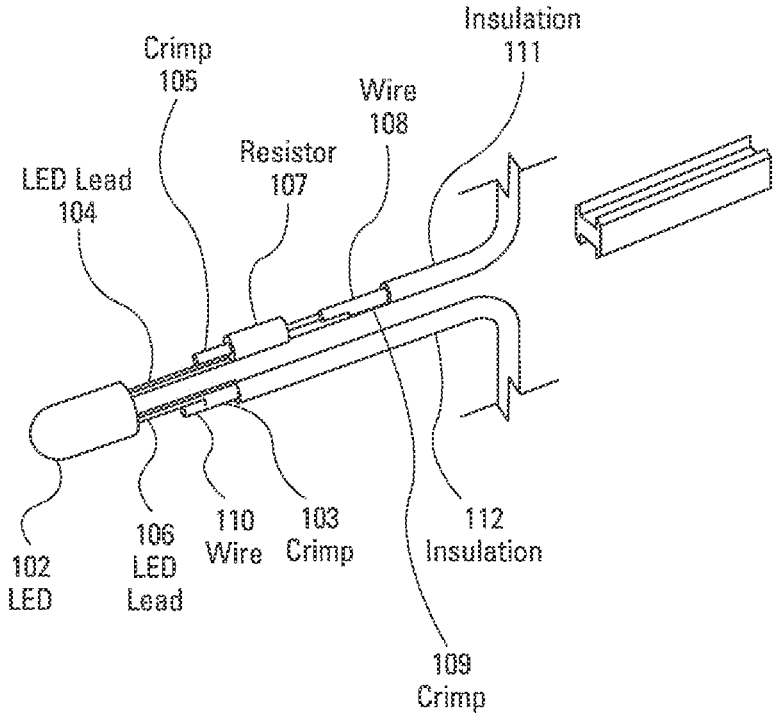
FIG. 1B is an isometric view of another embodiment of the invention.

FIG. 1B is an isometric view of another embodiment of the invention. As illustrated in FIG. 1B, LED 102 has LED leads 104, 106. LED 106 is connected to wire 110 via crimp 103. Insulation 112 covers the wire 110. LED 104 is connected to resistor 107 via crimp 105. Resistor 107 is connected to wire 108 via crimp 109. Wire 108 is covered with insulation 111. Wire 110 is covered with insulation 112 to isolate the two wires 108, 110. FIG. 1B simply illustrates the fact that a resistor 107 can be inserted in the positive lead, i.e., LED 104 to enhance the parallel connection of the series of LEDs such as LED 102 as described in FIG. 1C below. All of the other techniques disclosed herein such as the use of fusible insulator 114 disclosed in FIG. 4 and the other methods of isolating and insulating the leads of the LED 102 can be utilized. Additionally, although crimps, such as crimp 103, 105 and 109, can be used for either automatic or manual fabrication, automated or manual soldering techniques can also be used.

Figure 1C:
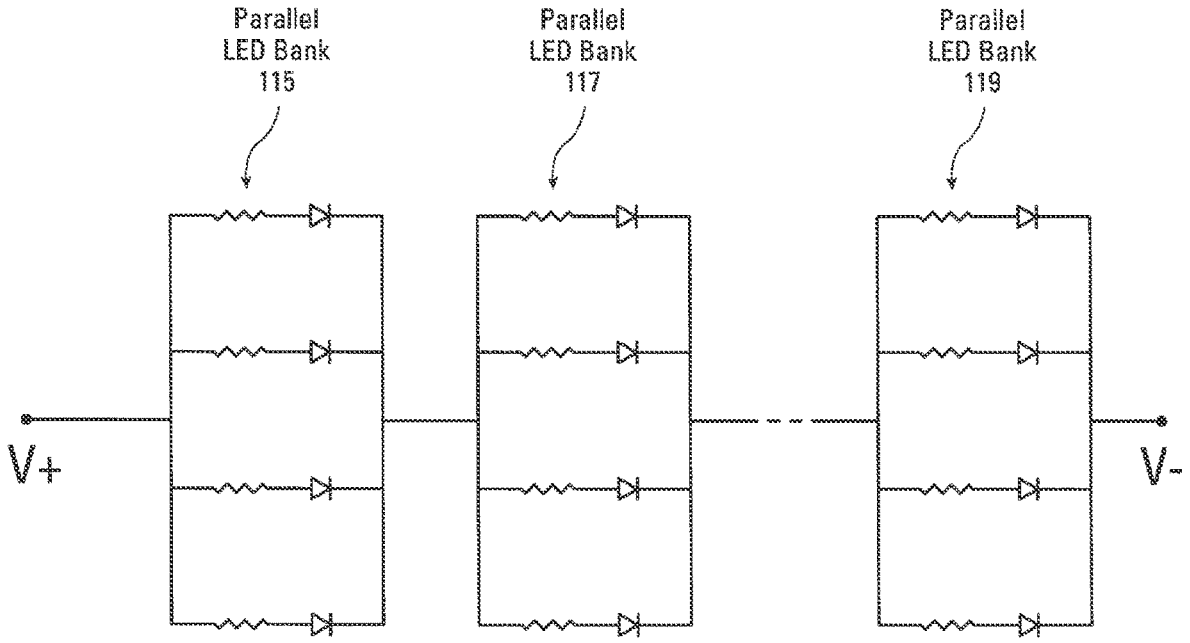
FIG. 1C is a schematic circuit diagram illustrating the manner in which the embodiment of FIG. 1B can be implemented in a light string.

FIG. 1C is a schematic circuit diagram of the manner in which the embodiment of FIG. 1B can be incorporated into a light string. As illustrated in FIG. 1C a series of parallel LED banks 115, 117, 119 are connected in series. The use of a resistor in line with each of the LEDs allows each of the parallel LED banks to continue to operate if an LED is shorted. Without a resistor in line with each of the LEDs, a shorted LED would short the entire parallel LED bank so that all of the LEDs in that bank would go dark if any of the LEDs in that bank were shorted. By placing a resistor in series with each LED, the parallel LED bank cannot be shorted out by any one LED or any combination of LEDs that are connected in parallel. The parallel LED banks 115, 117, 119 can be implemented in various ways such as by icicle strings in decorative Christmas lighting, in a matrix to increase light output from the LEDs. Matrices of LEDs can be used in automobile taillights, automobile headlights, traffic lights, flashlights, and various other implementations necessitating a greater light output. If the matrix of LEDs is a parallel connection, the use of a series resistor will protect the matrix from going dark by one or more LEDs being shorted. The implementation illustrated in FIG. 1B shows a convenient and automated method of assembling a resistor, such as resistor 107, in line with the LED 102 using manual or automated techniques for both crimping and soldering.

Figure 2:
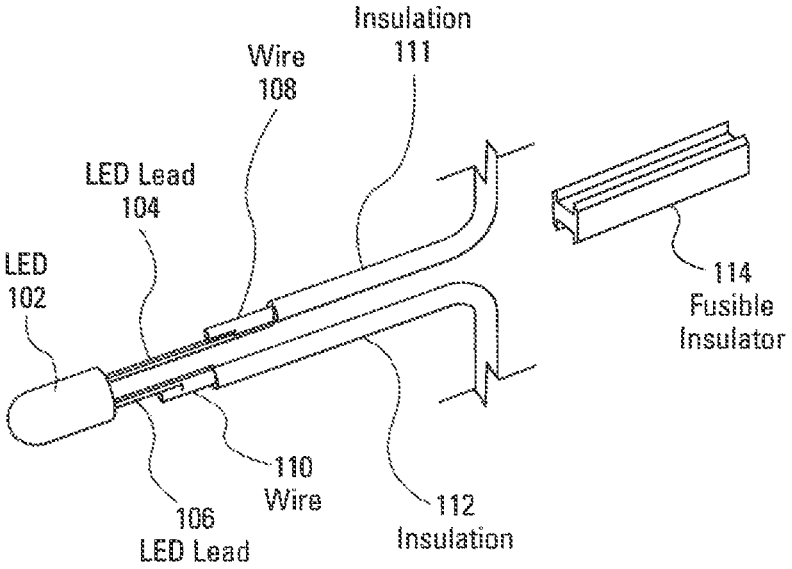
FIG. 2 illustrates the embodiment of FIG. 1 with a fusible insulator.

FIG. 2 is an assembly diagram illustrating a fusible insulator 14. Fusible insulator 114 is preferably made of a plastic material that has a melting temperature that is fairly low so that the assembly can be heated such as by a hot air gun so that the fusible insulator 114 can form around the LED leads 104, 106 from LED 102 and wires 108, 110. As illustrated in FIG. 2, the fusible insulator 114 has a center groove on both sides and wing portions that extend from the center groove.

Figure 3:
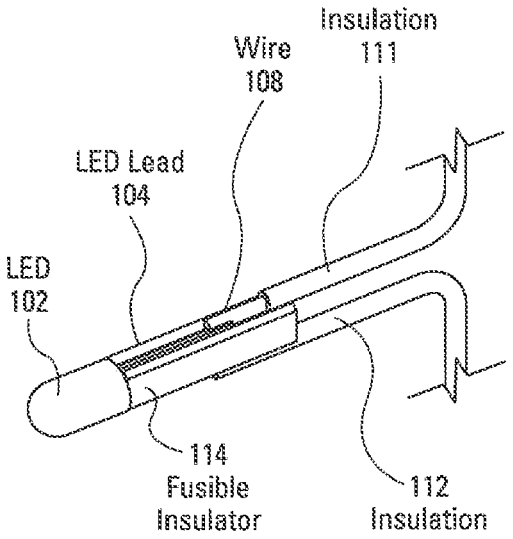
FIG. 3 is an isometric view of the embodiment of FIG. 1 with a fusible insulator inserted between LED leads.

FIG. 3 is an isometric view of the LED 102 and the fusible insulator 114. As illustrated in FIG. 3, the fusible insulator 114 is positioned between LED lead 104 and LED lead 106 (FIG. 2) and it butts against the LED 102. The groove in the fusible insulator fits between LED 104 and LED 106 to separate LED 104 and LED 106. The fusible insulator 114 is also long enough to extend to wires 108, 110 to ensure that wires 108, 110 (FIG. 2) are separated and insulated from one another. The fusible insulator 114 is sufficiently long to contact the full length of the bare wires 108, 110 and extends all the way to the insulation 111, 112 (FIG. 2). Fusible insulator 114 is a thermoplastic that can be melted and formed around the LED leads 104, 106 and wires 108, 110.

Figure 4:
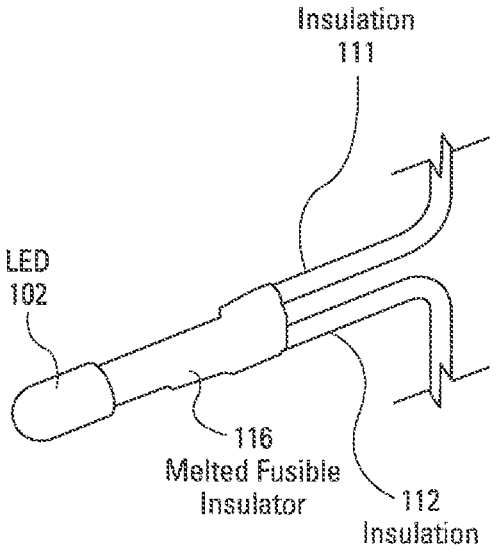
FIG. 4 is an isometric view of the LED with a melted fusible insulator.

FIG. 4 is an illustration of the embodiment of FIG. 3 with the fusible insulator 114 melted to form the melted fusible insulator 116. The melted fusible insulator 116 extends from the LED 102 all the way to insulation 111, 112 to ensure that the wires are insulated from one another and waterproofing is provided. The melted fusible insulator 116 can be melted by standard means such as application of hot air, higher radiation, and other sources.

Figure 5:
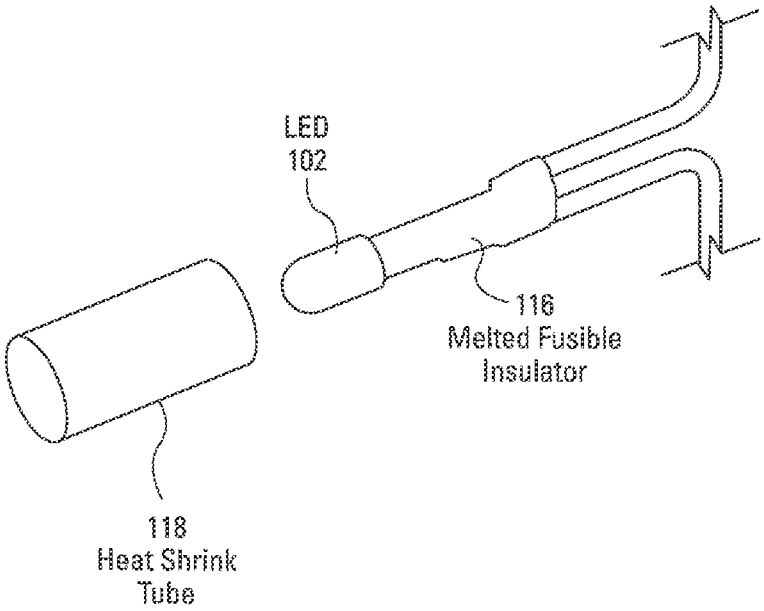
FIG. 5 is an isometric view of the LED with a melted fusible insulator in a heat shrink tube.

FIG. 5 is an assembly view of a heat shrink tube 118 and the LED 102 with the melted fusible insulator 116. The heat shrink tube 118 is passed over the LED 102 and over the melted fusible insulator 116. A portion of the heat shrink tube 118 covers the LED 102.

Figure 6:
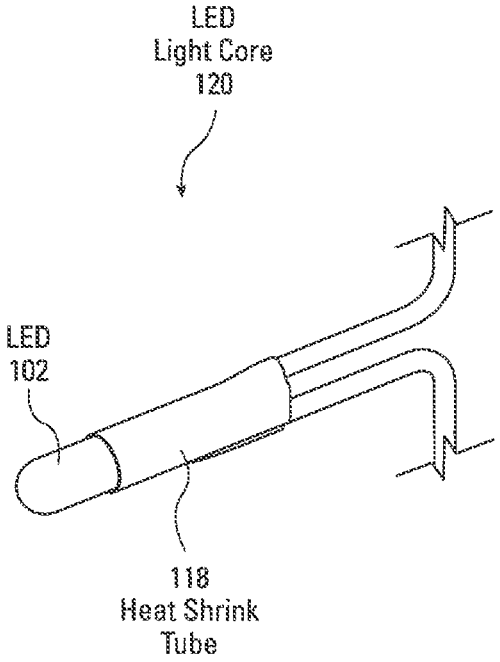
FIG. 6 is an embodiment of an LED light core.

As illustrated in FIG. 6, the heat shrink tube 118 is shrunk to form the heat shrink tube 122 which overlaps the LED 102 to form a watertight seal between the LED 102 and the melted fusible insulator 116. The heat shrunk tube 122 also forms a seal between the melted fusible insulator 116 and the heat shrunk tube 122 to further protect the LED light core 120 from water contamination.

Figure 7:
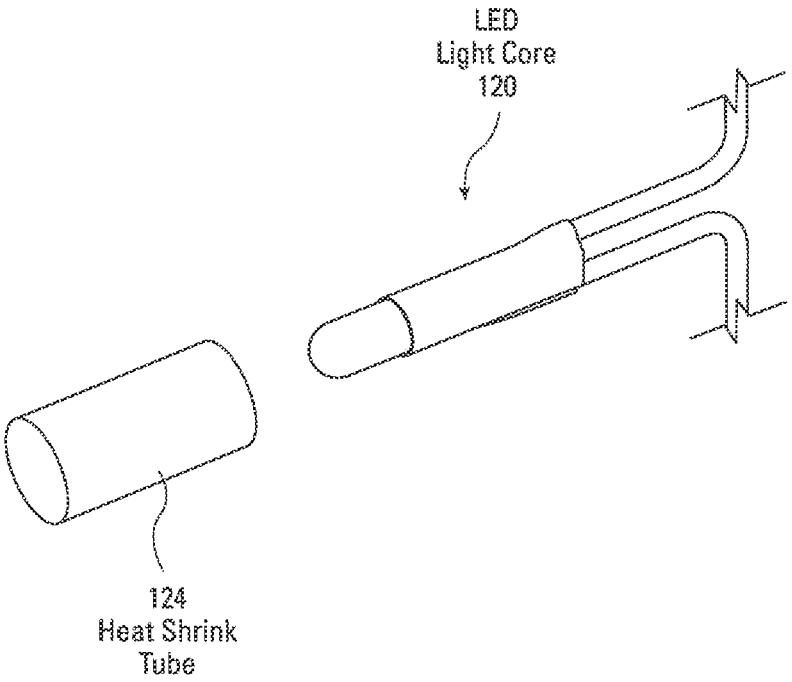
FIG. 7 is an isometric view of an LED light core with an additional heat shrink tube.

FIG. 7 is an assembly drawing of heat shrink tube 124 and LED light core 120. Heat shrink tube 124 is placed over the LED light core 120 to provide additional protection and greater watertightness to the LED core 120.

Figure 8:
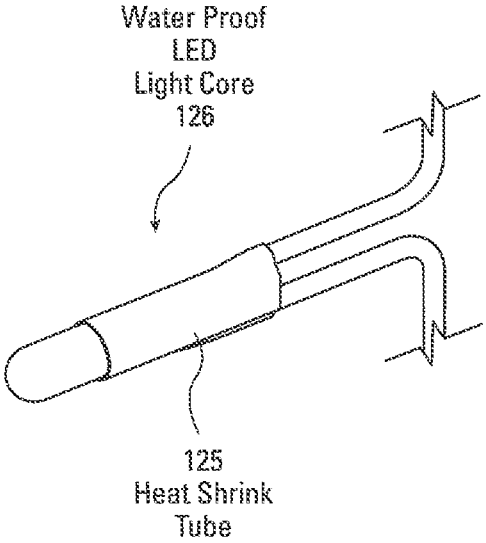
FIG. 8 is an embodiment of a waterproof LED light core.

FIG. 8 is an assembly drawing of the heat shrunk tube 125 placed on the LED core 120 to form the waterproof LED light core 126.

Figure 9:
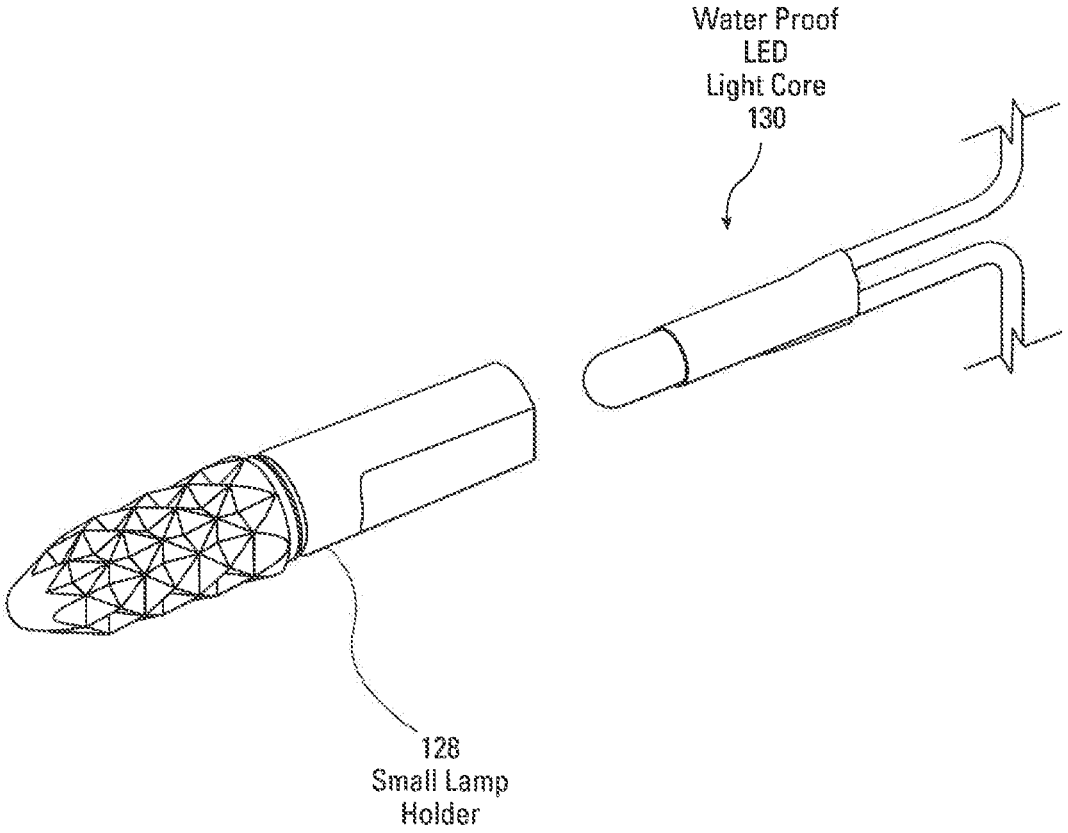
FIG. 9 is an assembly view of a watertight LED core and a small lamp holder.

FIG. 9 is an assembly drawing of a small lamp holder 128 and a waterproof LED light core 130. As illustrated in FIG. 9, the small lamp holder 128 is placed over the waterproof LED light core 130.

Figure 10:
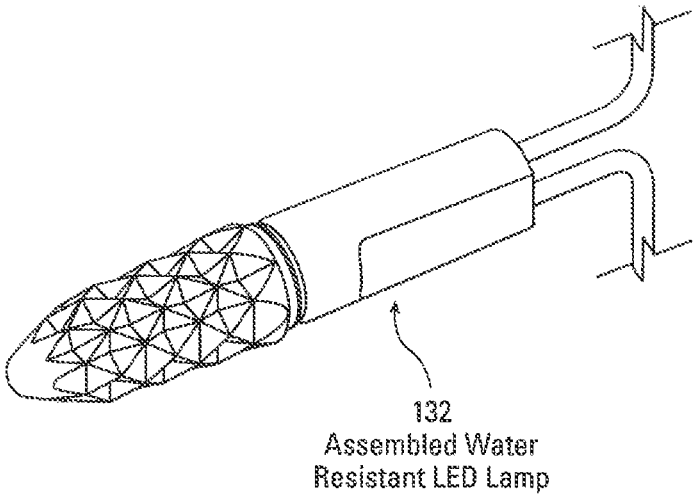
FIG. 10 is an embodiment of an assembled light core and small lamp holder.

FIG. 10 is an assembled view of the water-resistant LED lamp 132. The opening in the small lamp holder 128 forms a friction fit with the waterproof LED light core 130 so that the waterproof LED light core 130 is fixed in the small lamp holder 128.

Figure 11:
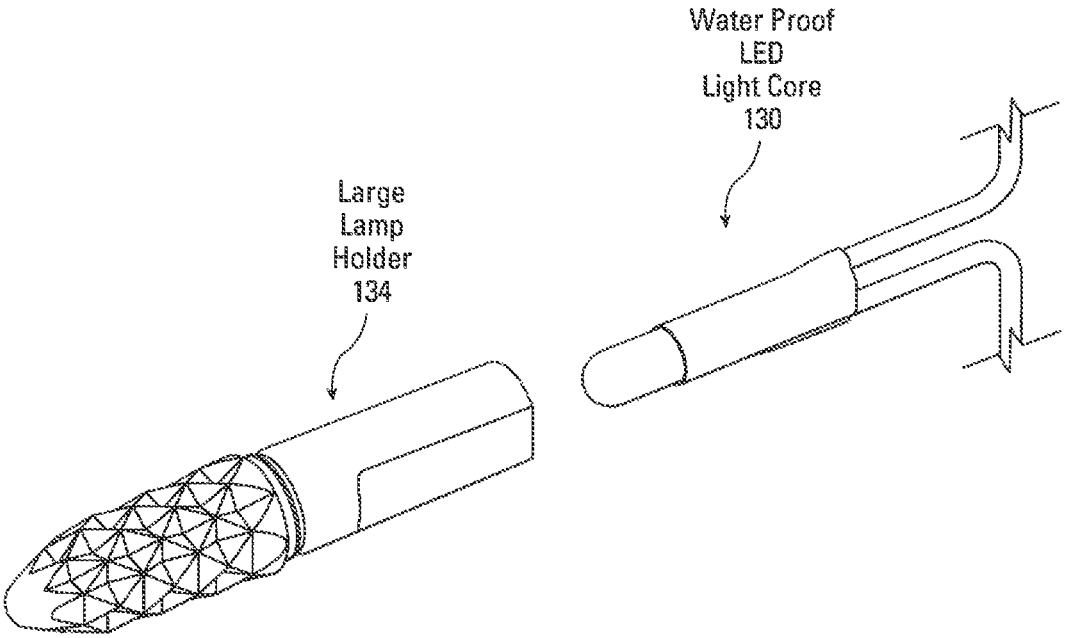
FIG. 11 is an assembly view of an LED light core and a large lamp holder.

FIG. 11 is an assembly view of large lamp holder 134 and a waterproof LED light core 130. The opening in the large lamp holder 134 provides a friction fit with the waterproof LED light core 130.

Figure 12:
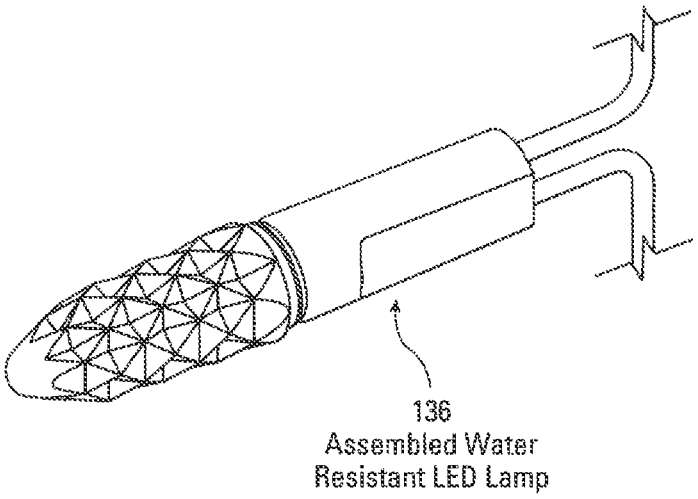
FIG. 12 is an embodiment of an assembled LED light core and large lamp holder.

FIG. 12 is an assembled view of the water-resistant LED lamp 136 which is formed by placing the waterproof LED light core 130 in the large lamp holder 134.

Figure 13:
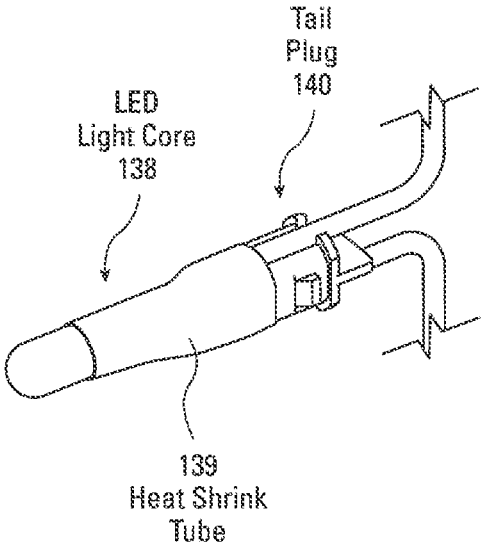
FIG. 13 is an isometric view of an embodiment of an LED light core having a tail plug.

FIG. 13 is an isometric view of an embodiment of an LED light core 138 having a tail plug 140. The tail plug can be secured by one or more heat shrink tubes to the LED light core 138. The heat shrink tube is placed over the LED and the tail plug 140 and then shrunk to create a heat shrunk tube 139 that secures the tail plug 140. Alternatively, the tail plug 140 can be secured to a fusible insulator to further secure the tail plug 140. Tail plug 140 can be secured to the fusible insulator using various bonding techniques including various adhesives or simply melting the fusible insulator to the tail plug 140.

Figure 14:
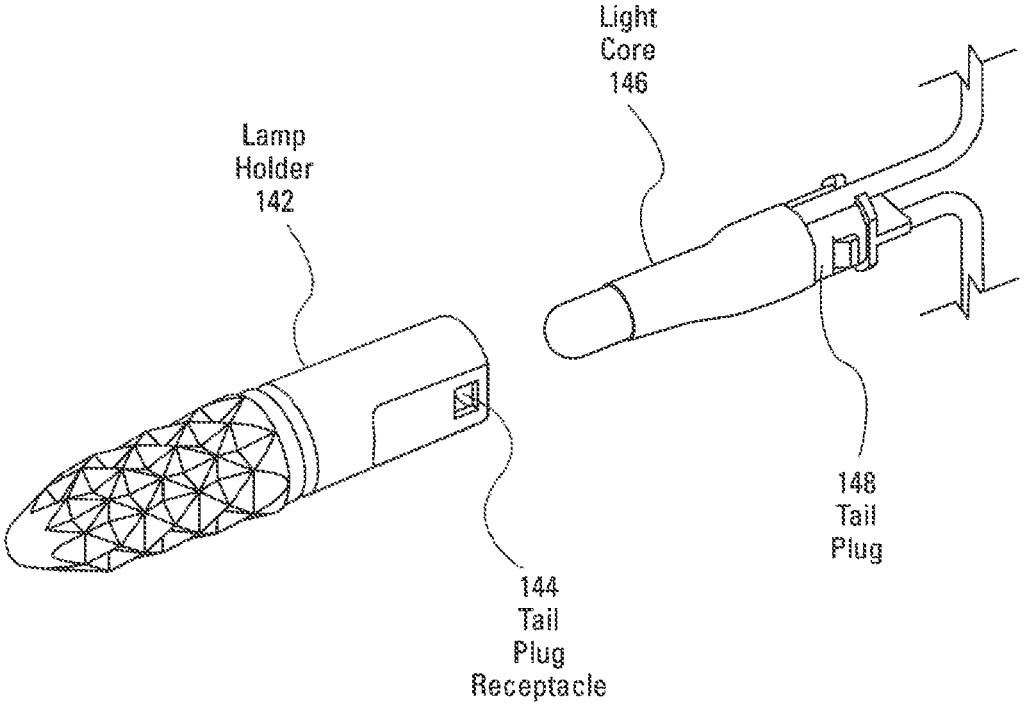
FIG. 14 is an embodiment of an LED light core having a tail plug and a lamp holder having a tail plug receptacle.

FIG. 14 is an assembly diagram of the lamp holder 142 having a tail plug receptacle 144 and a light core 146 having a tail plug 148. When the light core 146 is inserted into the lamp holder 142, tail plug 148 matches to the tail plug receptacle 144.

Figure 15:
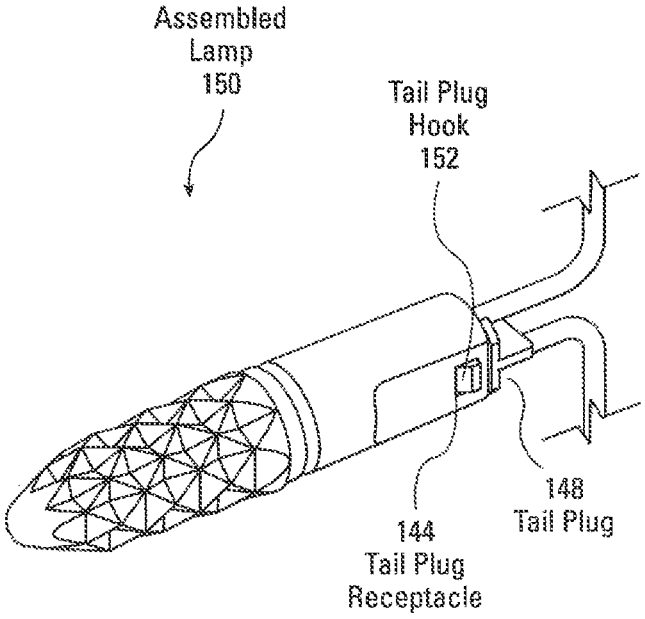
FIG. 15 is an isometric diagram of an embodiment of an assembled light core with a tail plug and a lamp holder having a tail plug receptacle.

FIG. 15 is an isometric view of an embodiment of the assembled lamp 150. As illustrated in FIG. 15, tail plug hook 152 of the tail plug 148 engages the tail plug receptacle 144 to secure the light core 146 to the lamp holder 142.

Figure 16:
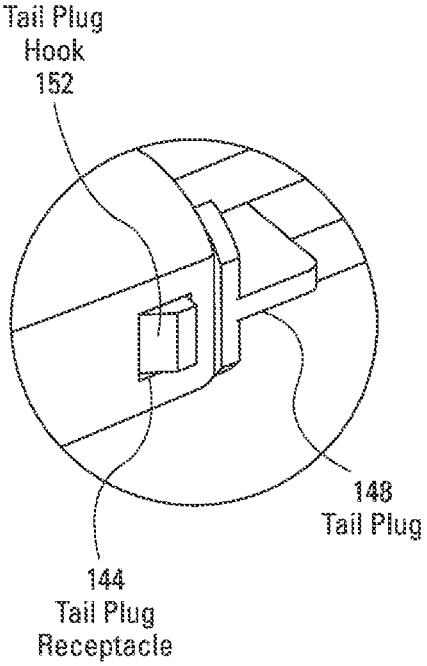
FIG. 16 is an exploded view of the tail plug and tail plug receptacle.

FIG. 16 is an exploded diagram illustrating the tail plug 148 and the manner in which the tail plug 152 engages the tail plug receptacle 144.

Figure 17:
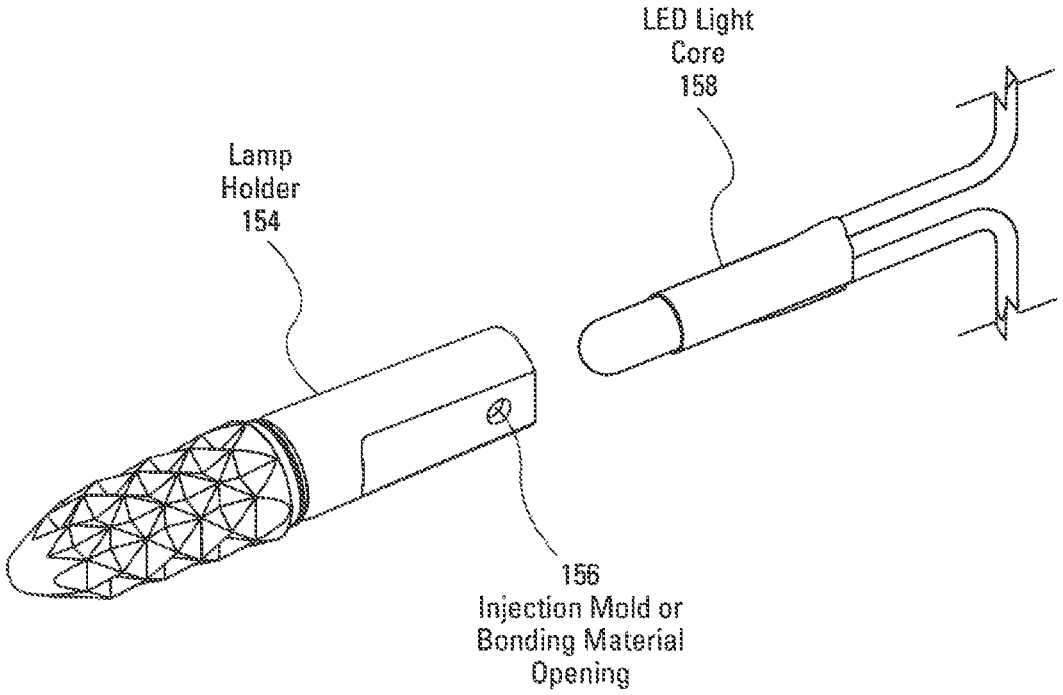
FIG. 17 is an isometric view of an embodiment of a light core and a lamp holder having an injection mold opening.

FIG. 17 is an isometric view of another embodiment of the present invention. As illustrated in FIG. 17, a lamp holder 154 is placed over LED light core 158. Lamp holder 154 has an injection mold opening 156 in which a liquified plastic (thermoplastic) can be injected after assembly of the lamp holder 154 and LED light core 158. Alternatively, a bonding material, that is waterproof, can be inserted in opening 156 to both hold the LED light core 158 in lamp holder 154 and provide a waterproof seal.

Figure 18:
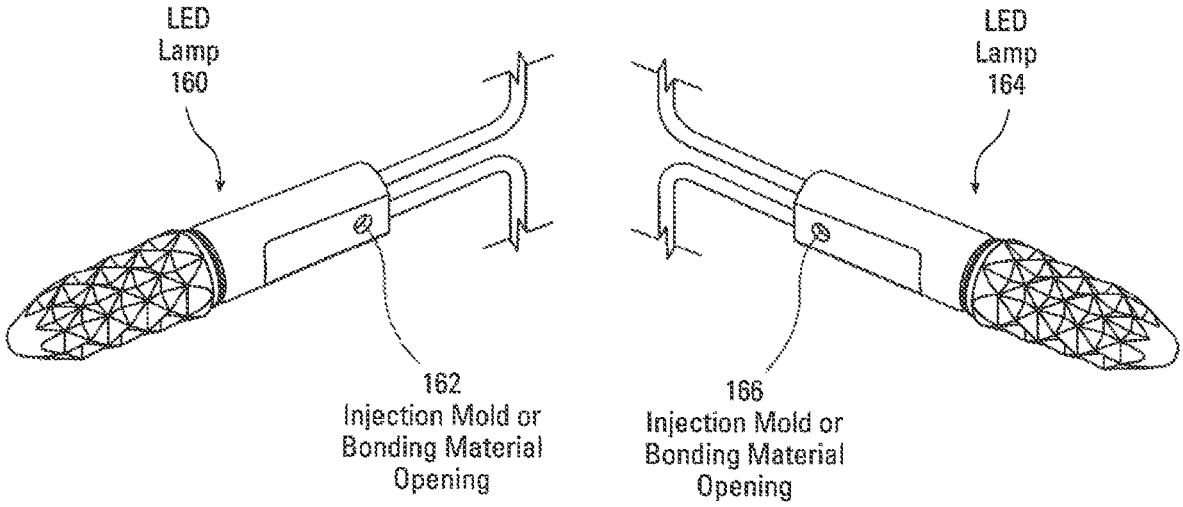
FIG. 18 is an isometric view of two assembled lamps illustrating injection mold openings on both sides of the lamp holder.

FIG. 18 is an isometric view of LED lamp 160 and LED lamp 164. Each of the LED lamps 160, 164 has an injection mold or bonding material opening on each side of the LED lamp. As illustrated in FIG. 18, LED lamp 160 has an injection mold or bonding material opening 162 on the first side and has another injection mold or bonding material opening on the other side of the LED lamp 160. This is illustrated in LED lamp 164 which has an injection mold or bonding material opening 166 and another injection mold or bonding material opening on an opposite side of the LED lamp 164.

Figure 19:
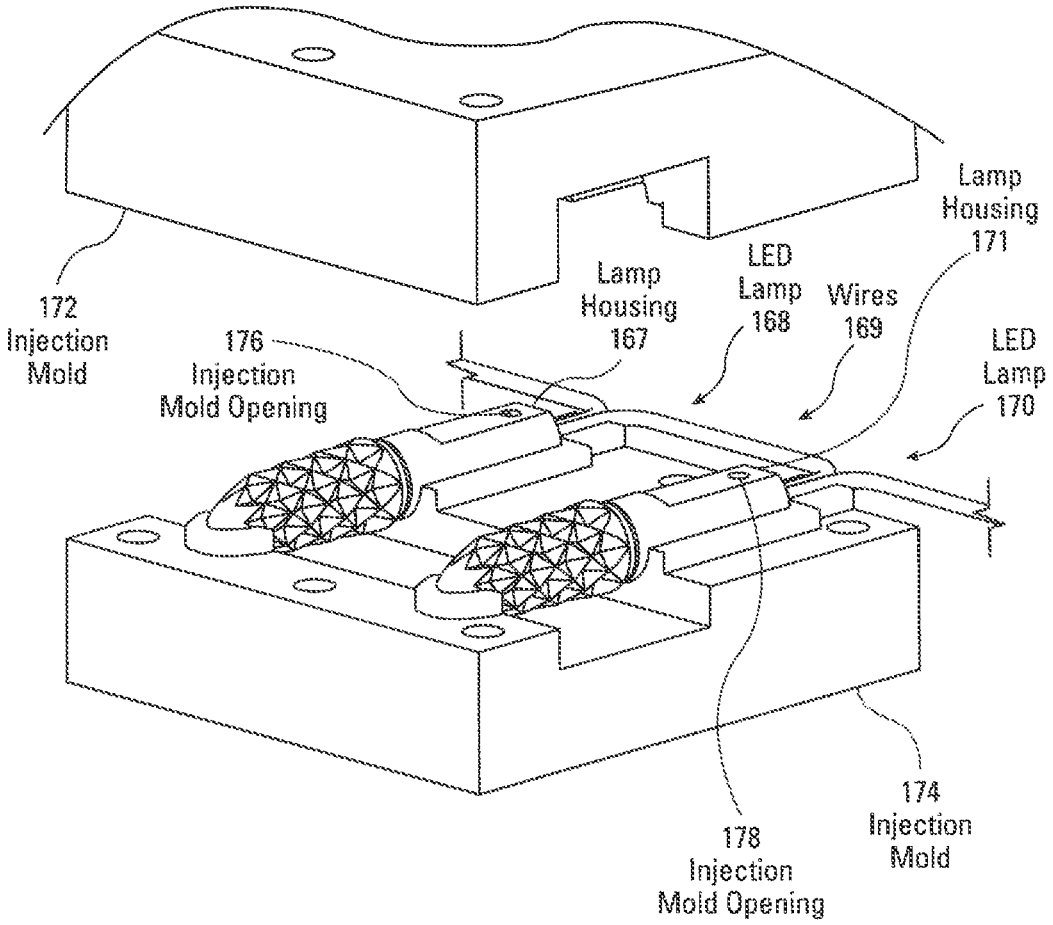
FIG. 19 is a schematic illustration of two LED lamps in an injection mold.

FIG. 19 is an isometric view of LED lamps 168, 170 that are placed in an injection mold having a top portion of the injection mold 172 and a bottom portion of the injection mold 174. LED lamp 168 has an injection mold opening 176. LED lamp 170 has an injection mold opening 178. When the top portion 172 of the injection mold is mounted to the bottom portion 174 of the injection mold, a molten plastic material is inserted through the injection mold openings 176, 178. The molten plastic cools in the space around the wires 169 and LED lamp housing 167 of LED lamp 168 and openings in lamp housing 171 around wires 169 and LED lamp 170. The openings are filled with the molten plastic which then cools to create a waterproof LED lamp.

Figure 20:
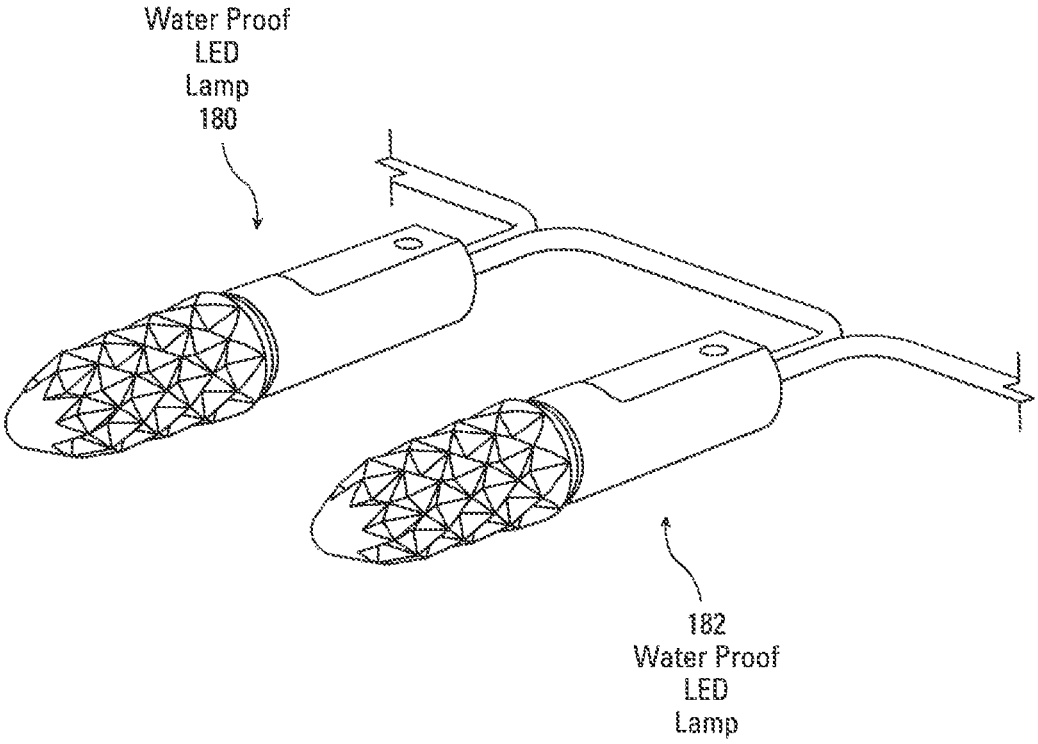
FIG. 20 is an embodiment of two LED lamps after injection molding.

FIG. 20 is an isometric diagram of waterproof LED lamp 180 and waterproof LED lamp 182 that have been injection molded to keep water from entering the lamp housing.

Figure 21:
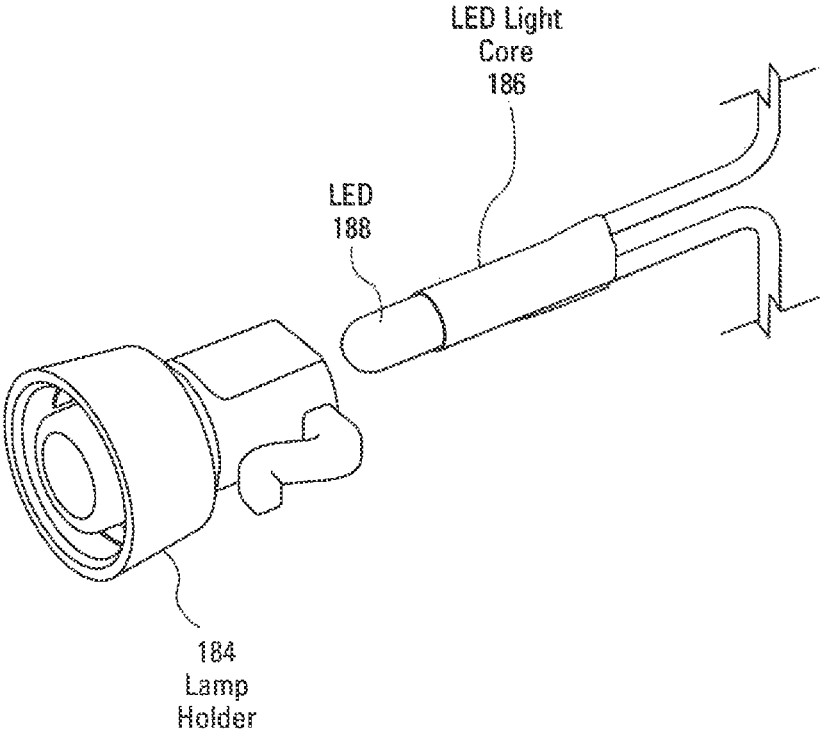
FIG. 21 is an isometric view of another embodiment of a lamp holder and LED light core.

FIG. 21 is an isometric diagram of another embodiment of an LED lamp. FIG. 21 is an assembly diagram showing the assembly of a lamp holder 184 and an LED light core 186 having an LED 188. Lamp holder 184 slides over the LED light core 186 until the LED 188 protrudes from the lamp holder 184.

Figure 22:
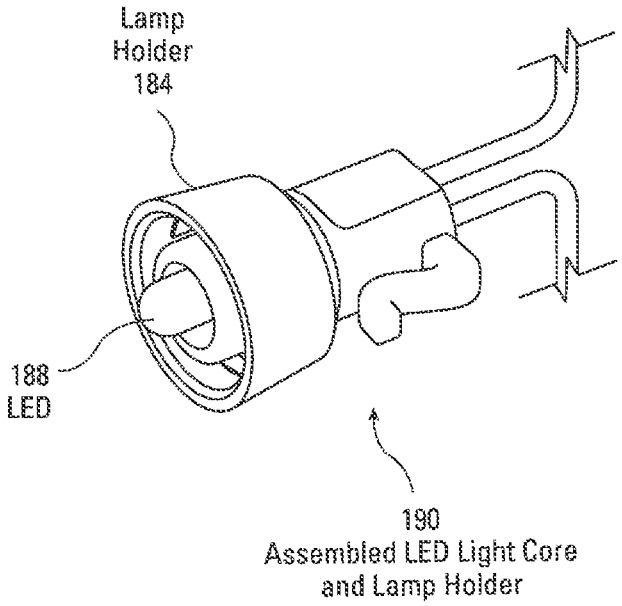
FIG. 22 is a schematic view of the embodiment of FIG. 21 as an assembled LED light core and lamp holder.

FIG. 22 illustrates the assembled lamp 190 comprising the LED light core 186 and lamp holder 184. As illustrated in FIG. 22, the LED 188 protrudes through an opening in the lamp holder 184 until the LED 188 extends from the lamp holder 184. A friction fit may be formed between the lamp holder 184 and the LED light core 186 to ensure that the assembled lamp 190 is fixed during an injection molding process.

Figure 23:
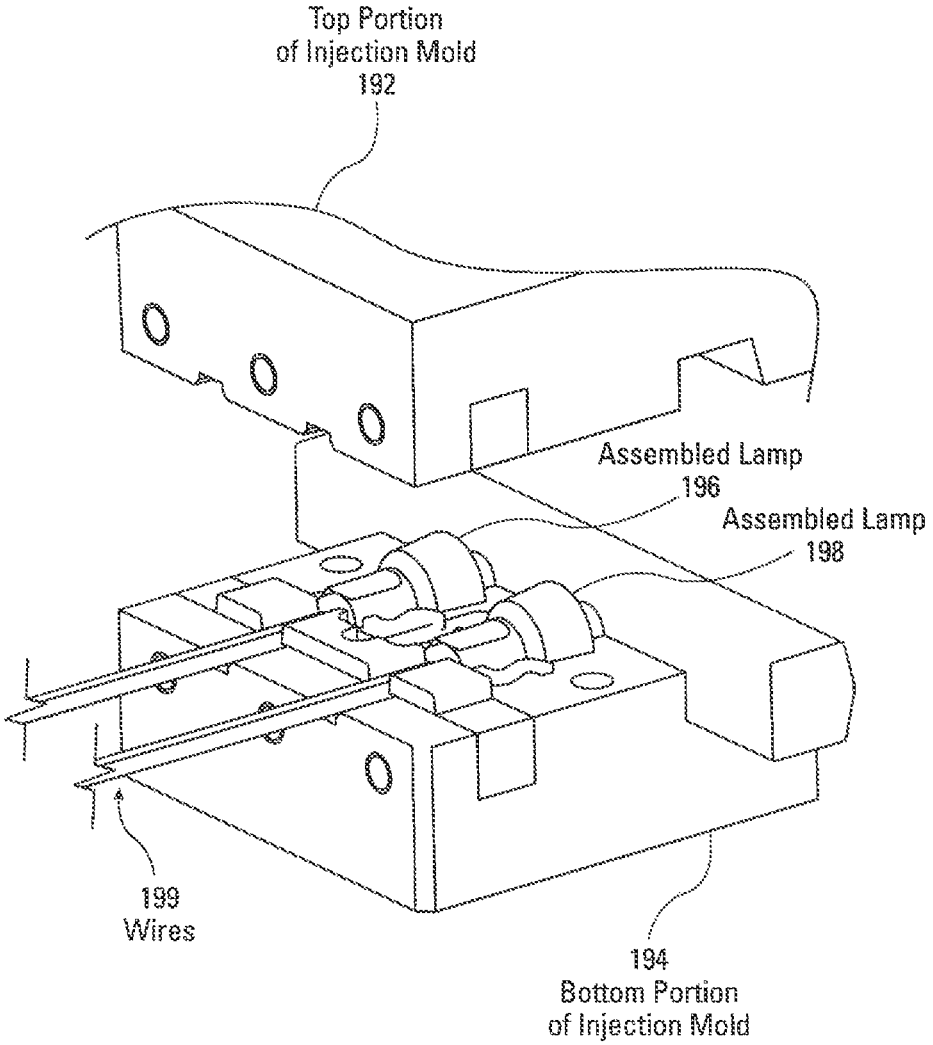
FIG. 23 is an isometric view of two lamp holders and an injection mold.

FIG. 23 is an isometric view of an embodiment of an injection molding device having a top portion 192 and a bottom portion 194 of the injection mold. The assembled lamps 196, 198 are placed in the injection mold and molten plastic is injected in the openings in the lamp holder 184 around the wires 199.

Figure 24:
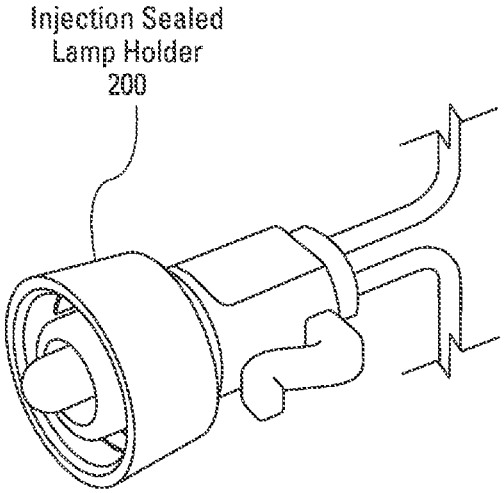
FIG. 24 is an isometric view of an assembled lamp holder.

FIG. 24 is an illustration of the embodiment of an injection sealed lamp holder 200. Molten plastic has been injected around the lamp holder 184 providing an injection sealed lamp holder 200 that is impervious to water.

Figure 25:
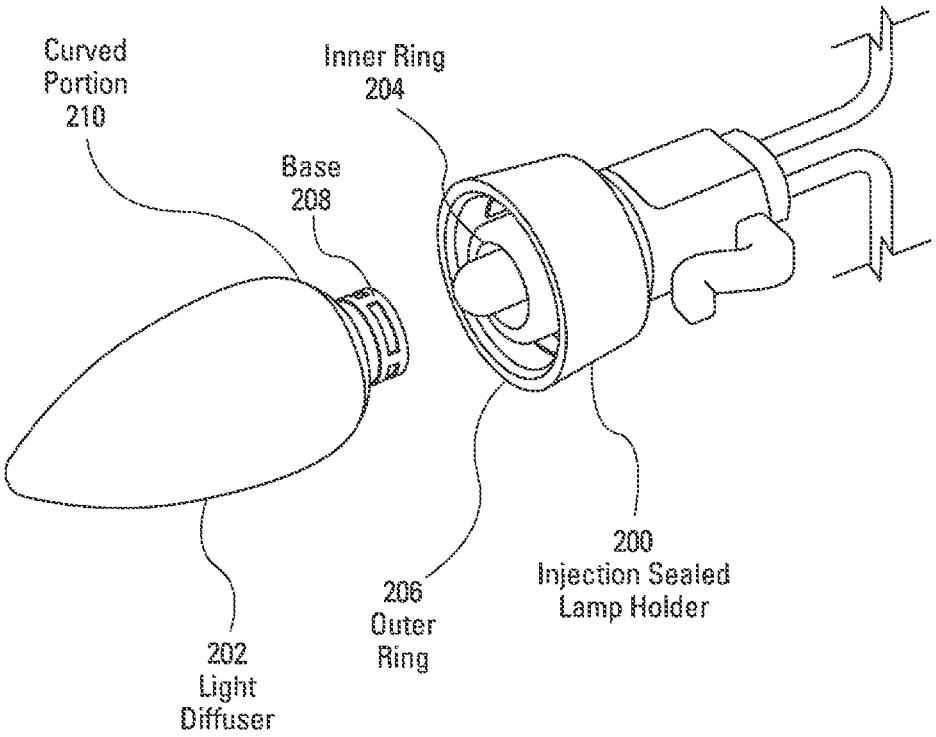
FIG. 25 is an assembly view of an assembled lamp holder and a light diffuser.

FIG. 25 is an assembly view another embodiment of an LED lamp. As illustrated in FIG. 25, the injection sealed lamp holder 200 has an outer ring 206 and an inner ring 204. A light diffuser 202 has a base 208 that is inserted inside of the inner ring 204 to form a watertight seal between the light diffuser and the injection sealed lamp holder 200. The light diffuser 202 is inserted into the injection sealed lamp holder 200 until the curved portion 210 of the light diffuser 202 is sealed against the outer ring 206. The seal between the curved portion 210 and the outer ring 206 prevents water from entering the injection sealed lamp holder 200.

Figure 26:
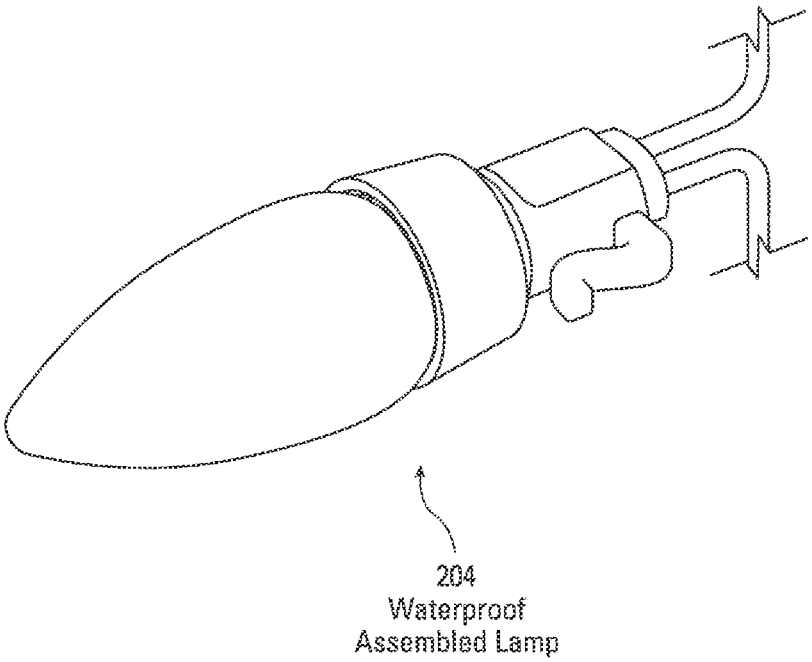
FIG. 26 is an isometric view of an assembled lamp.

FIG. 26 is an isometric view of an embodiment of the waterproof assembled lamp 204 corresponding to the assembly view of FIG. 25.

Consequently, both watertight and waterproof LED lamps are disclosed that can be utilized in outdoor settings. Straight forward and simple techniques for assembling the LED lamps are disclosed which can be automated and provide a reliable and quick method of forming LED lamps for outdoor use. Injection molding of the LED lamps allows the spaces in the LED lamps to be filled with a molten plastic to create a waterproof structure. Waterproofing allows the usage of these lamps in outdoor venues in a reliable fashion over a period of many years without the worry of corrosion or failure of the LED lamps.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A water resistant light emitting diode (LED) core comprising:

an LED element comprising:

a diode portion of said LED element;

a positive LED lead connected to said diode portion;

a negative LED lead connected to said diode portion;

an LED lens that covers said diode portion and connections of said positive LED lead and said negative LED lead to said diode portion so that said positive LED lead and said negative LED lead protrude from said LED lens;

a first wire connected to said positive LED lead to create a first electrical connection;

a second wire connected to said negative LED lead to create a second electrical connection:

a fusible insulator disposed between said positive LED lead and said negative LED lead that is partially melted to fuse to, and insulate, said positive LED lead, said first wire and said first electrical connection, and said negative LED lead, said second wire and said second electrical connection to form a partially melted fusible insulator;

at least one heat shrink tube that overlaps a portion of said LED lens and said partially melted fusible insulator that is shrunk to provide a watertight seal between said LED lens and said partially melted fusible insulator to produce said water resistant light core.

2. A light emitting diode (LED) lamp comprising:

a water resistant light core comprising:

an LED element comprising:

a diode portion of said LED element;

a first lead connected to said diode portion;

a second lead connected to said diode portion;

an LED lens that covers said diode portion and connections of said first lead and said second lead to said diode portion;

a first wire connected to said first lead to create a first electrical connection;

a second wire connected to said second lead to create a second electrical connection;

a fusible insulator disposed between said first lead and said second lead, said first wire and said second wire and said first electrical connection and said second electrical connection that is partially melted to fuse to, and insulate, said first lead and said second lead, said first wire and said second wire and said first electrical connection and said second electrical connection to form a partially melted fusible insulator;

at least one heat shrink tube that overlaps a portion of said LED lens and said partially melted fusible insulator that is shrunk to provide a watertight seal between said LED lens and said partially melted fusible insulator to produce a water resistant light core;

a lamp holder placed over said water resistant LED light core having a jacket with an opening formed in said jacket and a transmissive cover around said LED element to produce said LED lamp.

3. The LED lamp of claim 2 further comprising:

bonding material placed in said opening formed in said jacket that secures said lamp holder to said water resistant light core and seals said water resistant light core and said jacket.

4. The LED lamp of claim 2 further comprising:

a thermoplastic injected in said opening formed in said jacket that secures said lamp holder to said water resistant light core and seals said water resistant light core and said jacket to produce a waterproof LED lamp.

5. A method of making a water resistant light emitting diode (LED) light core comprising:

providing an LED element having a diode portion, a first LED lead connected to said diode portion, a second LED lead connected to said diode portion and an LED lens that covers said diode portion;

connecting a first wire to said first LED lead;

connecting a second wire to said second LED lead;

placing a fusible insulator between said first LED lead and said second LED lead, and between said first wire and said second wire;

partially melting said fusible insulator so that said fusible insulator fuses to, and insulates, said first LED lead and said second LED lead and said first wire and said second wire to form a partially melted fusible insulator;

at least one heat shrink tube placed around said partially melted fusible insulator and overlapping a portion of said LED lens;

applying heat to said heat shrink tube to shrink said heat shrink tube and seal said LED lens and said partially melted fusible insulator to form said water resistant LED light core.

6. A method of making a light emitting diode (LED) lamp comprising:

providing an LED element having a diode portion, a first LED lead connected to said diode portion, a second LED lead connected to said diode portion and an LED lens that covers said diode portion;

connecting a first wire to said first LED lead;

connecting a second wire to said second LED lead;

placing a fusible insulator between said first LED lead and said second LED lead, and between said first wire and said second wire;

partially melting said fusible insulator so that said fusible insulator fuses to, and insulates, said first LED lead and said second LED lead and said first wire and said second wire to form a partially melted fusible insulator;

at least one heat shrink tube placed around said partially melted fusible insulator and overlapping a portion of said LED lens;

applying heat to said heat shrink tube to shrink said heat shrink tube and seal said LED lens and said partially melted fusible insulator to form said water resistant LED light core;

placing a lamp holder over said water resistant LED light core to produce said LED lamp.

7. The method of claim 6 further comprising:

connecting a tail plug to said partially melted fusible insulator;

connecting said tail plug to a tail plug receptacle in said lamp holder.

8. The method of claim 6 further comprising:

placing bonding materials in openings formed in said lamp holder that secures said lamp holder to said water resistant LED light core to seal said water resistant LED light core and said lamp holder.

9. The method of claim 6 further comprising:

injecting a thermoplastic in openings in said lamp holder to secure said lamp holder and said water resistant LED light core and to seal said water resistant LED light core and said lamp holder to produce a waterproof LED lamp.

10. A series resistor LED light core comprising:

a water resistant light core comprising:

an LED comprising:

a diode portion of said LED element;

a first lead connected to said diode portion;

a second lead connected to said diode portion;

an LED lens that covers said diode portion and connections of said first lead and said second lead to said diode portion;

a resistor having a first end connected to said first lead to form a first electrical connection;

a first wire connected to a second end of said resistor to form a second electrical connection;

a second wire connected to said second lead to create a third electrical connection;

a fusible insulator disposed between said first lead, said resistor and said second lead, said first wire and said second wire and said first electrical connection, said second electrical connection and said third electrical connection, said fusible insulator being partially melted to fuse to, and insulate, said first lead, said resistor, and said second lead, said first wire and said second wire and said first electrical connection, said second electrical connection and said third electrical connection to form a partially melted fusible insulator;

at least one heat shrink tube that overlaps a portion of said LED lens and said partially melted fusible insulator that is shrunk to provide a watertight seal between said LED lens and said partially melted fusible insulator to produce a. water resistant light core.

11. The series resistor LED light core of claim 10 further comprising:

a lamp holder placed over said water resistant LED light core having a jacket with an opening formed in said jacket and a transmissive cover around said LED element to produce an LED lamp.

12. The LED lamp of claim 11 further comprising:

bonding material placed in said opening formed in said jacket that secures said lamp holder to said water resistant light core and seals said water resistant light core and said jacket to produce a waterproof LED lamp.

13. The LED lamp of claim 11 further comprising:

a thermoplastic injected in said opening formed in said jacket that secures said lamp holder to said water resistant light core and seals said water resistant light core and said jacket to produce a waterproof LED lamp.

14. A method of making a series resistor, water resistant light emitting diode (LED) light core comprising:

providing an LED element having a diode portion, a first LED lead connected to said diode portion, a second LED lead connected to said diode portion and an LED lens that covers said diode portion;

connecting said first LED lead to a first end of a resistor;

connecting a first wire to a second end of said resistor;

connecting a second wire to said second LED lead;

placing a fusible insulator between said first LED lead and said second LED lead, and between said first wire, said first end of said resistor, said second end of said resistor and said second wire;

partially melting said fusible insulator so that said fusible fuses to, and insulates, said first LED lead and said second LED lead and said first wire, said first end of said resistor, said second end of said resistor and said second wire to form a partially melted fusible insulator;

at least one heat shrink tube placed around said partially melted fusible insulator and overlapping a portion of said LED lens;

applying heat to said heat shrink tube to shrink said heat shrink tube and seal said LED lens and said partially melted fusible insulator to form said water resistant LED light core.

15. A method of making a light emitting diode (LED) lamp comprising:

providing an LED element having a diode portion, a first LED lead connected to said diode portion, a second LED lead connected to said diode portion and an LED lens that covers said diode portion;

connecting said first LED lead to a first end of a resistor;

connecting a first wire to a second end of said resistor;

connecting a second wire to said second LED lead;

placing a fusible insulator between said first LED lead and said second LED lead, and between said first wire, said first end of said resistor, said second end of said resistor and said second wire;

partially melting said fusible insulator so that said fusible fuses to, and insulates, said first LED lead and said second LED lead and said first wire, said first end of said resistor, said second end of said resistor and said second wire to form a partially melted fusible insulator;

at least one heat shrink tube placed around said partially melted fusible insulator and overlapping a portion of said LED lens;

applying heat to said heat shrink tube to shrink said heat shrink tube and seal said LED lens and said partially melted fusible insulator to form said water resistant LED light core;

placing a lamp holder over said water resistant LED light core to produce said LED lamp.

16. The method of claim 15, further comprising:

placing bonding materials in openings formed in said lamp holder that secures said lamp holder to said water resistant LED light core to seal said water resistant LED light core and said lamp holder.

17. The method of claim 15 further comprising:

injecting a thermoplastic in openings in said lamp holder to secure said lamp holder and said water resistant LED light core to seal said water resistant LED light core and said lamp holder to produce a waterproof LED lamp.

* * * * *